US011517491B2

(12) United States Patent
Doran

(10) Patent No.: US 11,517,491 B2
(45) Date of Patent: Dec. 6, 2022

(54) ADJUSTABLE STRETCH SUPPORT APPARATUS

(71) Applicant: Barry Doran, Pasadena, TX (US)

(72) Inventor: Barry Doran, Pasadena, TX (US)

( * ) Notice: Subject to any disclaimer, the term of this patent is extended or adjusted under 35 U.S.C. 154(b) by 167 days.

(21) Appl. No.: 17/038,580

(22) Filed: Sep. 30, 2020

(65) Prior Publication Data

US 2022/0096307 A1 Mar. 31, 2022

(51) Int. Cl.
*A61H 1/00* (2006.01)
*A61H 1/02* (2006.01)

(52) U.S. Cl.
CPC ..... *A61H 1/0244* (2013.01); *A61H 1/0266* (2013.01); *A61H 1/0281* (2013.01); *A61H 2201/0192* (2013.01); *A61H 2201/164* (2013.01); *A61H 2201/1635* (2013.01)

(58) Field of Classification Search
CPC ..... A61H 1/0244; A61H 1/02; A61H 1/0266; A61H 2201/1635; A61H 2201/164; A61H 1/00; A61H 1/0214; A63B 2213/00; A63B 23/03575; A63B 2023/006; A63B 23/0482
See application file for complete search history.

(56) References Cited

U.S. PATENT DOCUMENTS

| | | | | |
|---|---|---|---|---|
| 4,270,749 | A | 6/1981 | Hebern | |
| 5,094,445 | A * | 3/1992 | Winkelvoss | A61H 1/0229 482/142 |
| 5,518,476 | A | 5/1996 | McLeon | |
| 7,169,098 | B1 | 1/2007 | McGanty | |
| 7,402,128 | B2 | 7/2008 | Thonn, Jr. | |
| 2014/0187389 | A1 * | 7/2014 | Berg | A61H 1/0292 482/91 |

* cited by examiner

*Primary Examiner* — Samchuan C Yao
*Assistant Examiner* — Sarah B Lederer
(74) *Attorney, Agent, or Firm* — Darryl E. Scott

(57) ABSTRACT

An apparatus for stretching a human body comprising a floor frame having a central axis. A first beam is coupled substantially perpendicular to the floor frame. The first beam has a foot pedal, a knee support, and a waist support. A second beam coupled substantially perpendicular to the floor frame, the second beam having a plurality of lower arm handles. A third beam is coupled substantially perpendicular to the floor frame. A fourth beam is adjacently coupled to the third beam. The third beam has a plurality of upper arm handles.

20 Claims, 6 Drawing Sheets

ADJUSTABLE STRETCH SUPPORT APPARATUS

BACKGROUND

Stretching apparatuses that focus on a person's standing posture are available but are limited in functionality. For example, those types of stretching apparatuses are not adequately designed to stretch a person's achilles, back, arms, and shoulders in a full composite stretch such that each muscle group is engaged in a deep and overlapping way. In addition, those stretching machines are not ergonomically designed for a person's body, thus requiring the person to endure pain in order to fully stretch. Performing a deep stretch in the shoulders, arms, back, legs, and achilles while in a stable and relaxed position is a challenge.

DETAILED DESCRIPTION

Figure 1:
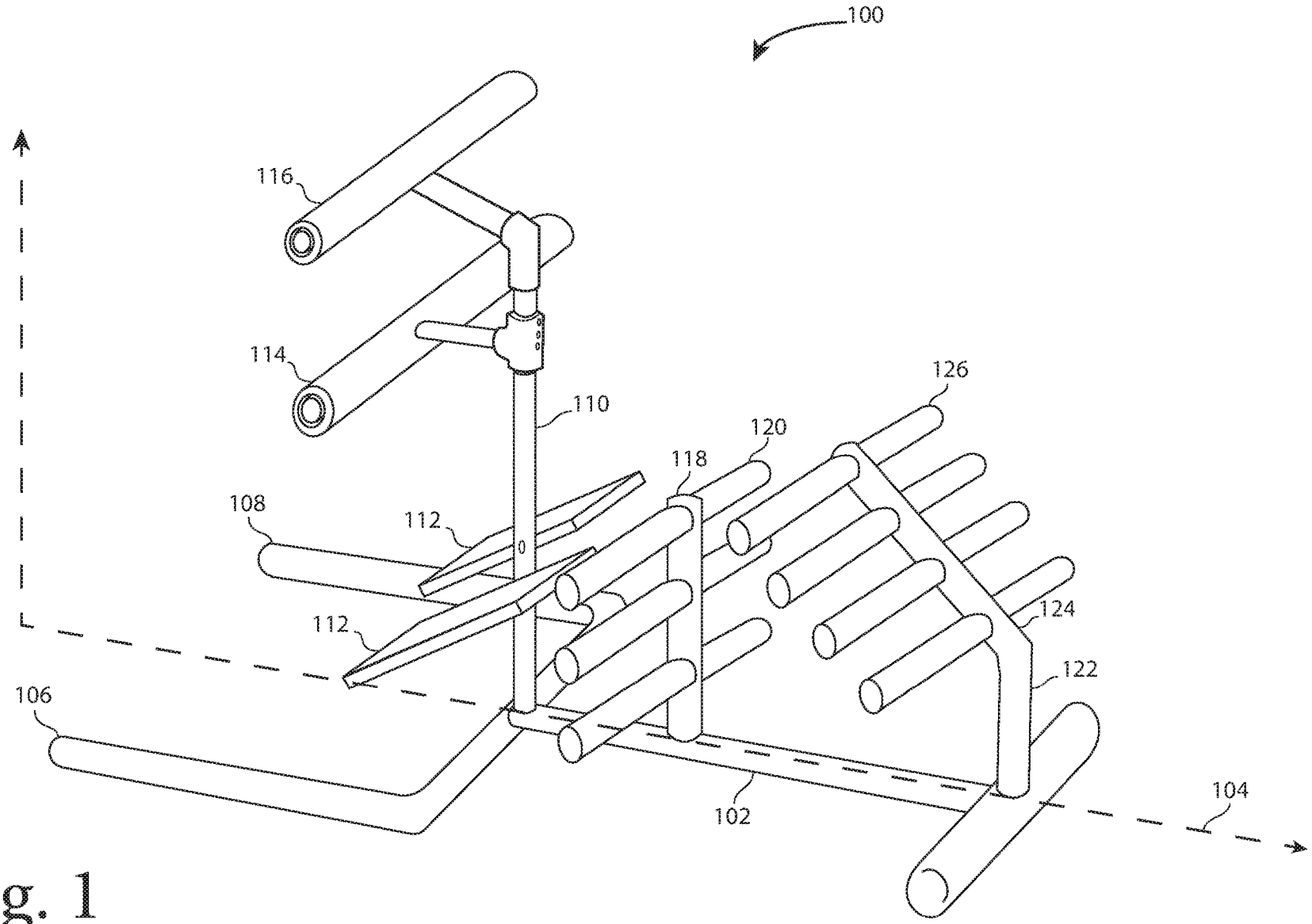
FIG. 1 is a perspective view of a stretching apparatus.

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Efforts have been made to develop an apparatus that improves a person's back pain, leg and hip ailments, and arm aliments. For example, stretching apparatuses that focus on a person's standing postures are available but are limited in capacity and functionality. Standing apparatuses cannot stretch a person's achilles tendon, back, arms, and shoulders in a full composite stretch such that each area is deeply engaged. In a "bent-forward" position (e.g., sitting on the floor and stretching forward toward the person's toes) the person can engage those muscles, however the position is unconventional and adds extra stress and unnecessary pain to the person. A conventional posture is necessary. The muscle should not be in a "flexed" or "tensed" state when being stretched.

Also, there are many institutions that require a person to be relatively flexible. Institutions, such as physical therapy centers, gyms, exercise centers, athletic centers, dance studios, and martial arts dojos require deep stretch apparatus to assist their patrons before engaging in strenuous activities. Unfortunately, one challenge of seated stretching (i.e., the person is seated on a flat surface such as a floor) is that the knees tend to collapse forward countering the hamstring stretch. A second challenge occurs when a person bends forward to touch their toes in a standing straight leg posture. In this position the hamstring remains under tension because the hamstring must hold the weight of the bent forward position. A third challenge in toe-touching while in a seated position on the floor is that the ankle is not on an inclined plane which would, if inclined, provide a deepen stretch of the ankle. A fourth challenge is the inability of pulling forward in the seated positioned. Without the use of a handle or fixed tool, the person has to rely on their own flexibility and core muscles to pull forward to stretch. Conversely, while in a standing position the floor becomes a limiting barrier to which a person can extend their stretch. The stretching apparatus described herein eliminates these challenges.

The stretching apparatus described herein supports a human body (i.e., a person) in various stretching postures. The stretching apparatus can cause a deep stretch in the back, shoulder, and arms while simultaneously affecting a deeper stretch in the hamstrings, calves, and achilles tendon. The stretching apparatus is adjustable on several axis, posts, and heights. For example, the height of the waist support and knee support can be adjusted. In one or more embodiments, there are a plurality of handles that can be held by the person. One set of handles are located close to the person's feet while the other set may be located adjacent the person's feet thus requiring the person to reach forward to achieve a variety of stretch positions. These embodiments allow users of many sizes to be able to utilize the apparatus in a multitude of postures.

One of the elements of the stretching apparatus allows for the stretch of the muscles behind the knee. Stretching the behind-the-knee muscle is challenging because the body tends to collapse the knees forward when the hamstring is under tension. The stretching apparatus addresses this issue by providing a knee support to prevent the knee from collapsing forward.

Another embodiment of the stretch apparatus is that the person's waist can be supported by a waist support. The waist support is configured to support a portion of the body weight while the body is bent over, thus allowing the muscles to relax. Further, the stretching apparatus has handles (i.e., bars) the person can grip while in a stretched positioned. For example, the person's hips can rest against the waist support and the person can grip the handles to pull themselves forward to deepen the stretch without tensing the hamstring muscle. Also, the person can rest their feet on pedals that are designed to pivot on angle from the horizontal base such that the foot can rest on an incline. This will affect a deeper stretch as the heel can drop.

Figure 2:
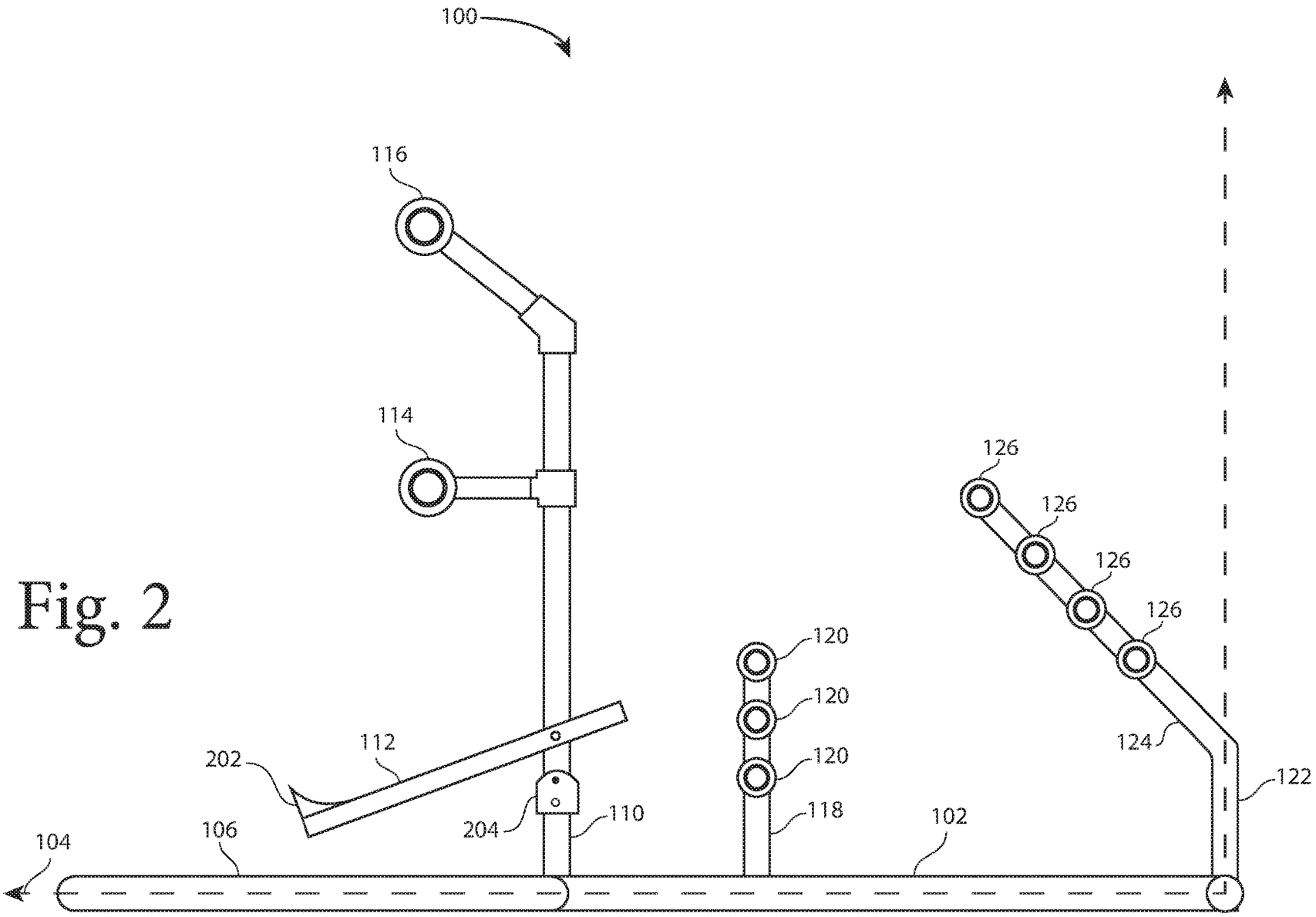
FIG. 2 is a profile view of a stretching apparatus.

FIG. 1 is a perspective view of a stretching apparatus. FIG. 2 is a profile view of a stretching apparatus. The stretching apparatus 100 may be made of a metal alloy, a polymer, or other similar material. The stretching apparatus 100 may have a floor frame 102. The floor frame 102 provides support and stability for the stretching apparatus 100 while a person (not shown in FIG. 1 or 2 but illustrated in FIGS. 4A and 5A) is engaged in a stretching exercise. The floor frame 102 may have a central axis 104 that runs along the center of the floor frame 102. In one or more embodiments, the floor frame 102 may include a first anti-tipping beam 106 and a second anti-tipping beam 108. Note, only one tipping beam is visible in FIG. 2 for clarity. The anti-tipping beams 106 and 108 restrict the stretching apparatus 100 from rotating and falling over while the person (not shown) is engaged in a stretching maneuver. The anti-tipping beams 106 and 108 may be positioned in various configurations (not shown in FIGS. 1 and 2 but illustrated in FIGS. 3A-3F).

As illustrated in FIGS. 1 and 2, the stretching apparatus 100 may include a first beam 110 coupled substantially perpendicular (i.e., within one, three, or five degrees) to the floor frame 102. The first beam 110 is positioned along the central axis 104 of the floor frame 102. In one or more embodiments, the first beam 110 includes a foot pedal 112. The foot pedal 112 is coupled to the first beam 110 by screws or other similar methods. The foot pedal 112 is the element the person (not shown) uses to stretch their achilles tendon. For example, the foot pedal 112 is pivotable (i.e. rotate about the screws or other similar coupling mechanism), thus allowing the person to rotate and stretch their ankles (i.e., achilles tendon) while engaging the stretching apparatus 100. The foot pedal 112 can pivot and lock between sixty degrees and negative sixty degrees about the central axis 104. The foot pedal 112 may include anti-slip material, such as rubber matting or other similar slip resistant material. As illustrated in FIG. 2, the foot pedal 112 may include a foot brace 202. The foot brace 202 restricts the person's foot from shifting backwards (i.e., in the direction of the person's heal) while engaging in a stretch.

In one or more embodiments, the stretching apparatus 100 includes a knee support 114. The knee support 114 is coupled to the first beam 110 above the foot pedal 112. In one or more embodiments, the knee support 114 is adjustable. For example, the knee support 114 can be positioned along the first beam 110 to align with the person's knee. The knee support 114 may be cushioned to provide more comfort to the person when the knee is engaged with the knee support 114.

The stretching apparatus 100 may include a waist support 116. The waist support 116 is coupled to the first beam 110 above the knee support 114. The waist support 116 supports the weight of the person while they are engaging in a stretch exercise. In one or more embodiments, the waist support 116 is cushioned to provide more comfort to the person when engaging in a stretching exercise. In one or more embodiments, the waist support 116 is adjustable. For example, the waist support 116 may be positioned along the first beam 110 to align with the user's waist.

As illustrated in FIG. 2, the first beam 110 may be pivotable. For example, the first beam 110 may include a pivot coupling 204. In one or more embodiments, the pivot coupling 204 allows the first beam 110 to rotate about an axis point such that the waist support 116 can be shifted forward or backwards and locked toward the central axis 104.

Further illustrated in FIGS. 1 and 2 is a second beam 118. The second beam 118 is coupled substantially perpendicular (i.e., within three, ten, or fifteen degrees) to the floor frame 102. In or more embodiments, the second beam 118 includes a coupling or joint (not shown) such that it can be rotated about an axis inline with the central axis 104. The second beam 118 is positioned along the central axis 104 inline with the first beam 110. In one or more embodiments, the first beam 110 includes a plurality of lower arm handles 120. Note, although FIGS. 1 and 2 illustrates three lower arm handles 120, the stretching apparatus 100 may include a greater or lesser number of lower arm handles 120 than illustrated. Also note, only one lower arm handle 120 is labeled in FIG. 1 for clarity. When engaged, the person grips the lower arm handles 120 to pull themselves toward the handles to effectuate a stretch of their arms, back, hamstring, and achilles tendon.

In one or more embodiments, the stretching apparatus 100 includes a third beam 122. The third beam 122 is coupled substantially perpendicular (i.e., within one, three, or five degrees) to the floor frame 102. The third beam 122 may be positioned along the central axis 104 of the floor frame 102. Thus, the first beam 110, the second beam 118, and the third beam 122 are consecutively positioned along the central axis 104. As illustrated in FIGS. 1 and 2, the stretching apparatus 100 includes a fourth beam 124 adjacently coupled to the third beam 122. For example, the third beam 122 and fourth beam 124 may form an angle of between one hundred and ten degrees and one hundred sixty degrees. Note, these angles are proximate, thus the angle of connection of the third beam 122 and fourth beam 124 can be between ninety-one degrees and one hundred seventy-nine degrees. In one or more embodiments, the fourth beam 124 includes a plurality of upper arm handles 126. Note, although FIGS. 1 and 2 illustrates three upper arm handles 126, the stretching apparatus 100 may include a greater or lesser number of upper arm handles 126 than illustrated. When engaged, the person grips the upper arm handles 126 to pull themselves toward the handles to effectuate a stretch of their arms, back, hamstring, and achilles tendon.

Figure 3A:
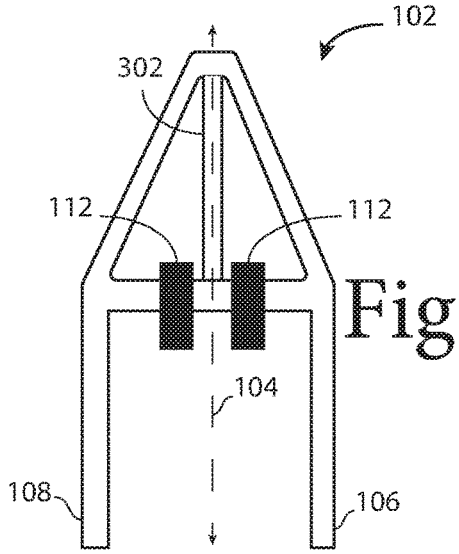
FIGS. 3A-F are aerial views of different variations of floor frames having a foot pedal.
Figure 3B:
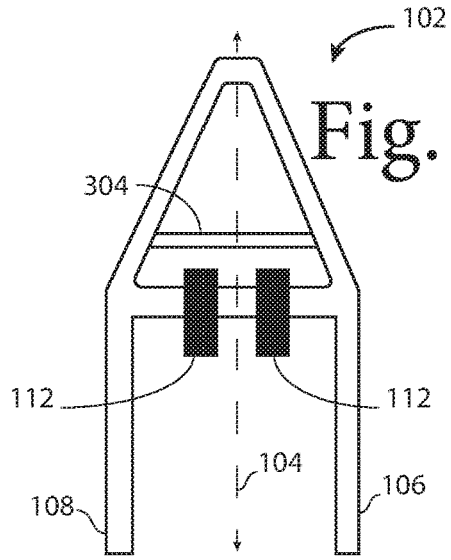
Figure 3C:
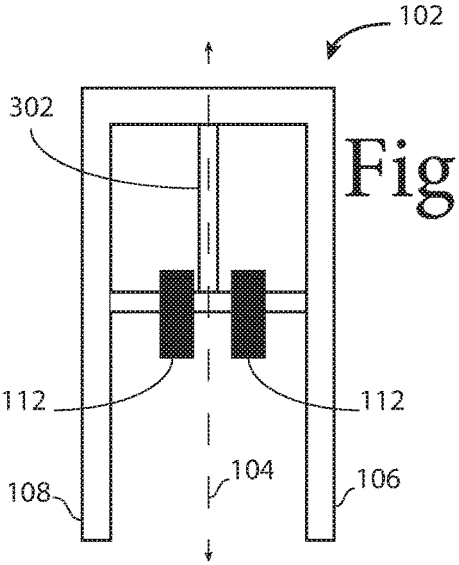
Figure 3D:
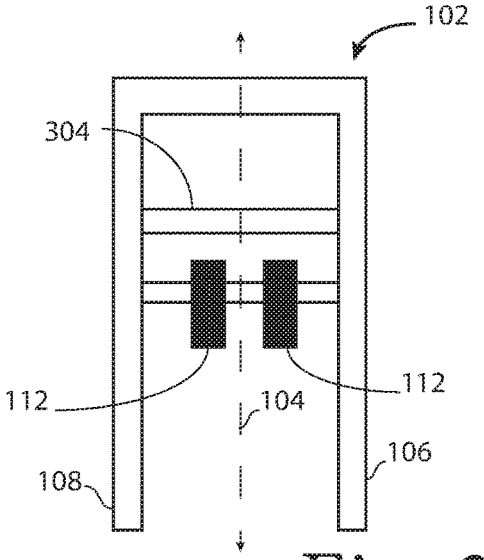
Figure 3E:
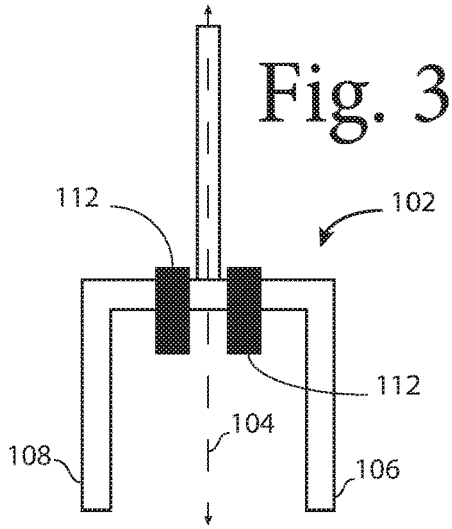
Figure 3F:
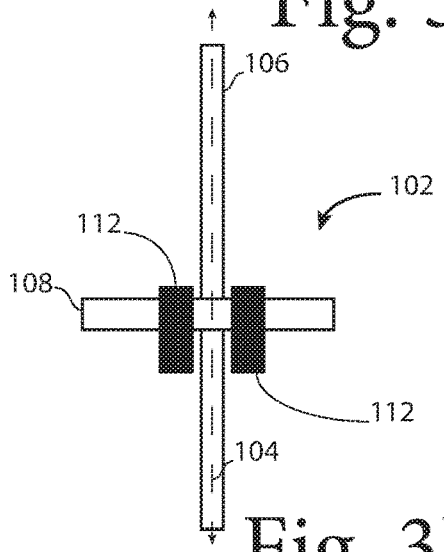

FIGS. 3A-F are aerial views of different variations of floor frames having a foot pedal. FIG. 3A illustrates the floor frame 102 as an A-frame. In FIG. 3A, a center beam 302 is aligned with the central axis 104 of the floor frame 102. Conversely, FIG. 3B illustrates the A-frame floor frame 102 with a cross beam 304 positioned substantially perpendicular (i.e., within one, three, or five degrees) to the center axis 104. In both illustrations (FIGS. 3A and 3B) the floor frames 102 include the first anti-tipping beam 106 and the second anti-tipping beam 108. In one or more embodiments, as illustrated FIGS. 3C and 3D the floor frames 102 form a U-frame. In FIG. 3C, the center beam 302 is aligned with the central axis 104 of the floor frame 102. Conversely, in FIG. 3D illustrates the U-frame floor frame 102 with the cross beam 302 positioned substantially perpendicular (i.e., within one, three, or five degrees) to the center axis 104. In both illustrations (FIGS. 3C and 3D) the floor frames 102 include the first anti-tipping beam 106 and the second anti-tipping beam 108. In one or more embodiments, as illustrated in FIG. 3E the floor frame 102 my form a Y-frame. Alternatively, as illustrated in FIG. 3F, the floor frame 102 may form a T-frame. In both illustration, (i.e., FIGS. 3E and 3F) the floor frames 102 include the first anti-tipping 106 and the second anti-tipping frame 108.

Figure 4A:
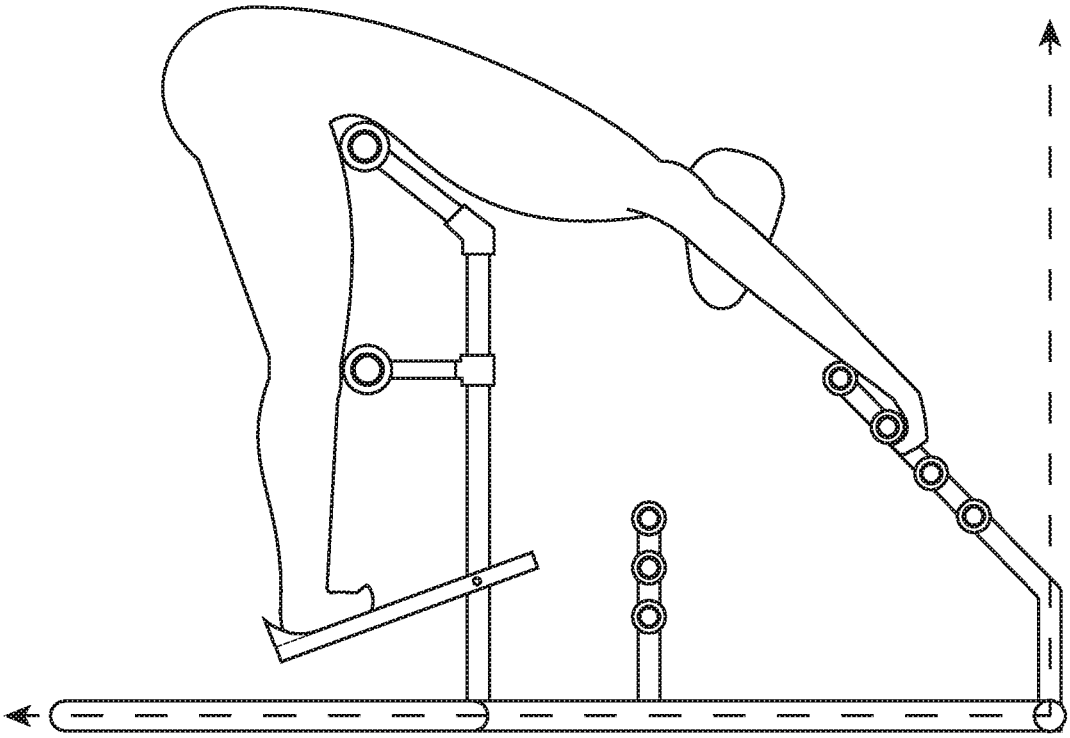
FIG. 4A is a profile view of a person engaging a stretching apparatus.
Figure 4B:
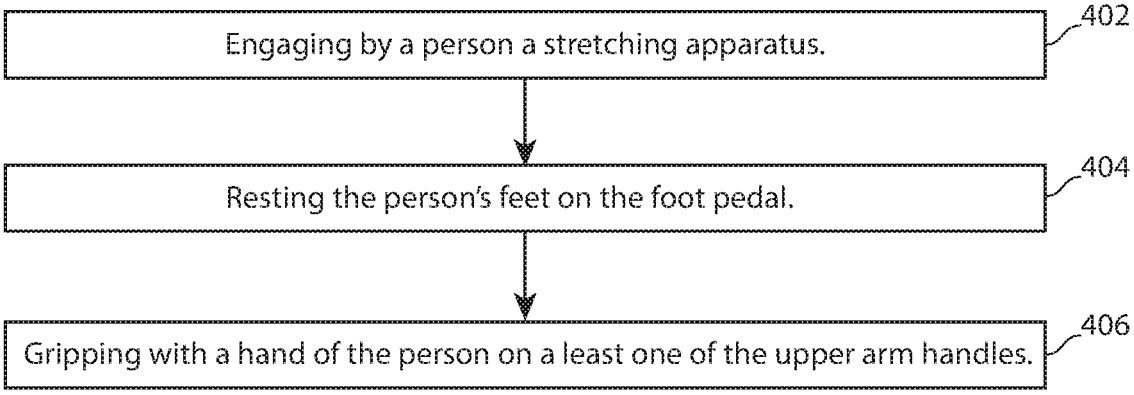
FIG. 4B is a flow chart of a method of a person engaging a stretching apparatus.

FIG. 4A is a profile view of a person engaging a stretching apparatus. FIG. 4B is a flow chart of a method of a person engaging a stretching apparatus. The method includes a person engaging the stretching apparatus (such as stretching apparatus 100) (block 402). The person rests their feet on the foot support (such as foot pedal 112) (block 404). The person gripping with a hand on at least one of the upper arm handles (such as upper arm handle 126) (block 406). As illustrated in FIG. 4A, once engaged, the person pulls themselves forward toward the upper arm handles 126 and stretches the hamstring, back, and arms.

Figure 5A:
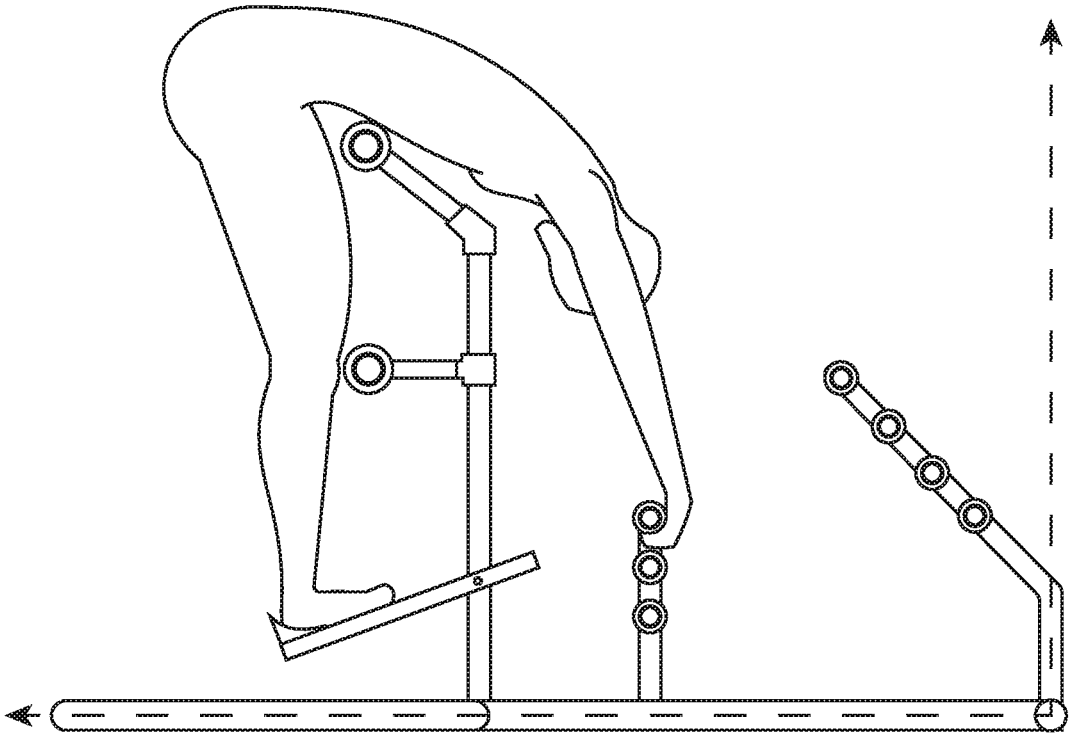
FIG. 5A is an alternate profile view of a person engaging a stretching apparatus.
Figure 5B:
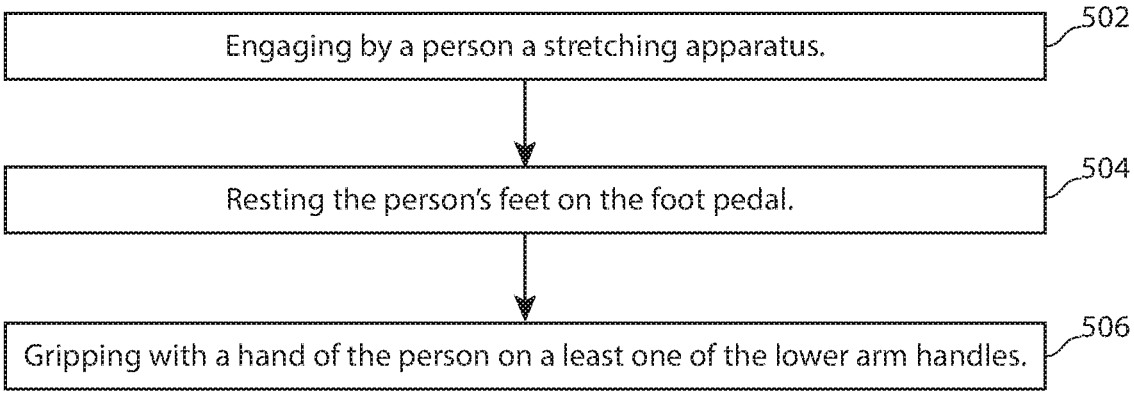
FIG. 5B is an alternate flow chart of a method of a person engaging a stretching apparatus.

FIG. 5A is an alternate profile view of a person engaging a stretching apparatus. FIG. 5B is an alternate flow chart of a method of a person engaging a stretching apparatus. The method includes a person engaging the stretching apparatus (such as stretching apparatus 100) (block 502). The person rests their feet on the foot pedal (such as foot pedal 112) (block 504). The person gripping with a hand on at least one of the lower arm handles (such as lower arm handle 120) (block 506). As illustrated in FIG. 5A, once engaged, the person pulls themselves forward toward the lower arm handles 120 and stretches the hamstring, back, and arms.

Figure 6:
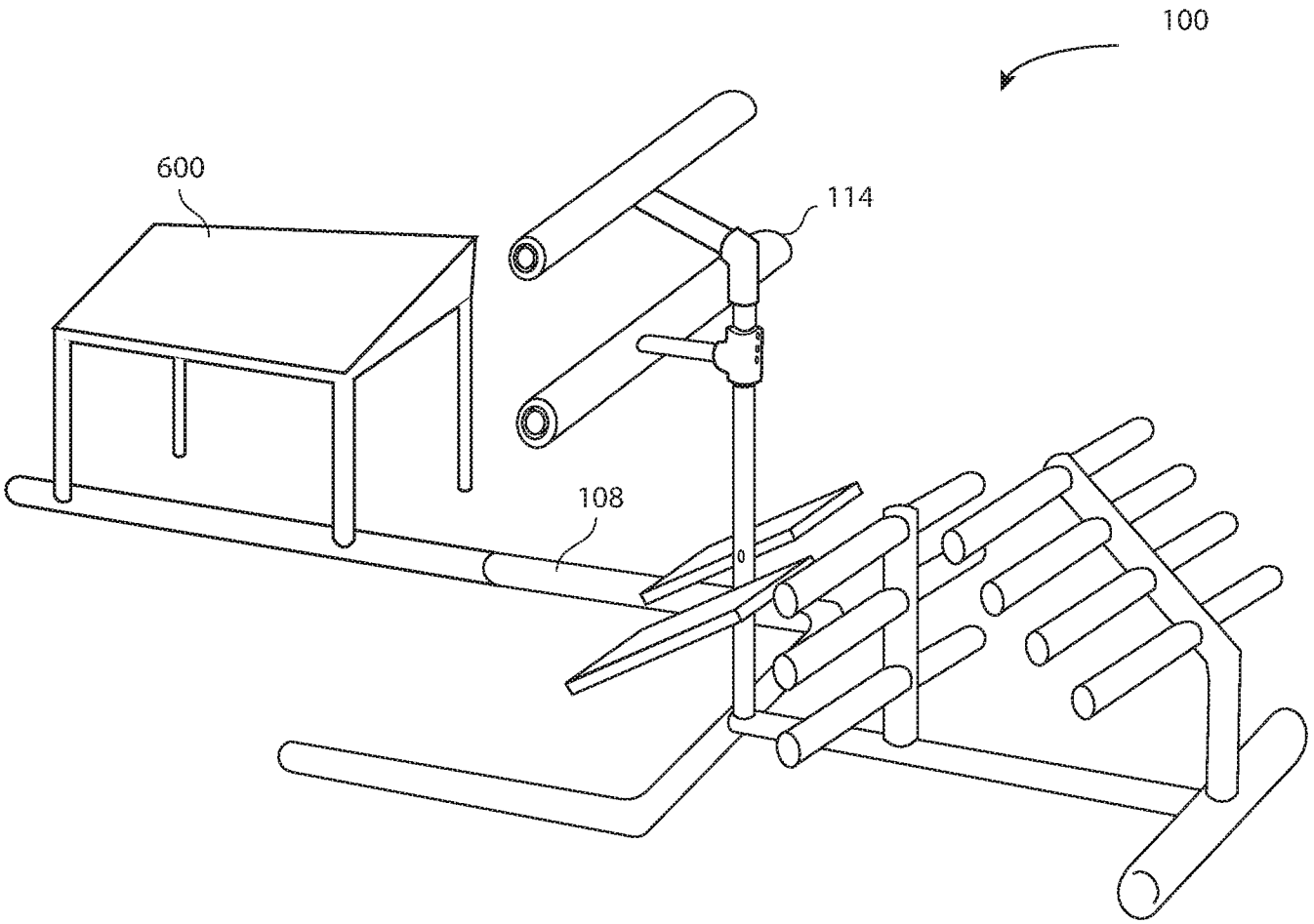
FIG. 6 is a profile view of a stretching apparatus having a ballerina stretch bar.

FIG. 6 is a profile view of a stretching apparatus having a ballerina stretch bar. The stretching apparatus 100 may include a ballerina stretch bar 600. The ballerina stretch bar may be coupled to the first anti-tipping beam 106. In one or more embodiments, the ballerina stretch bar 600 may be coupled to the second anti-tipping beam 108. In another embodiment, the stretching apparatus 100 may include a first ballerina stretch bar (not illustrated in FIG. 6) coupled to the first anti-tipping beam 106 and a second ballerina stretch bar (not illustrated in FIG. 6) coupled to the second anti-tipping beam 108. The ballerina stretch bar 600 resembles, in one or more embodiments, a sawhorse table. For example, the ballerina stretch bar 600 may have a surface top comprised of a beam (not shown in FIG. 6) or cushion table. In one or more embodiments, the surface top or beam of the ballerina stretch bar 600 is parallel to the knee support 114. The person (not shown) may form a ballerina split by positioning one leg on the knee support 114 and the other leg on the surface of the ballerina stretch bar 600. The ballerina stretch bar 600 allows the person to perform a deep quadricep and inner thigh stretch without the strain of balancing themselves while maintaining the stretched position.

In one aspect, the apparatus for stretching a human body includes a floor frame having a central axis. The stretching apparatus includes a first beam coupled substantially perpendicular to the floor frame. The first beam includes a foot pedal, a knee support, and a waist support. The stretching apparatus includes a second beam coupled substantially perpendicular to the floor frame. The second beam includes a plurality of lower arm handles. The stretching apparatus includes a third beam coupled substantially perpendicular to the floor frame. The stretching apparatus includes a fourth beam adjacently coupled to the third beam. The third beam has a plurality of upper arm handles.

Implementation may include one or more of the following. The first beam, the second beam, and the third beam may be positioned consecutively along the central axis. The floor frame may include a first anti-tipping beam and a second anti-tipping beam. The foot support may be pivotable. The knee support may be adjustable. The waist support may be adjustable. The waist support may be cushioned.

In one aspect, the method for stretching a human body includes a person engaging a stretching apparatus. The stretching apparatus includes a first beam coupled substantially perpendicular to the floor frame. The first beam includes a foot pedal, a knee support, and a waist support. The stretching apparatus includes a second beam coupled substantially perpendicular to the floor frame. The second beam includes a plurality of lower arm handles. The stretching apparatus includes a third beam coupled substantially perpendicular to the floor frame. The stretching apparatus includes a fourth beam adjacently coupled to the third beam. The third beam has a plurality of upper arm handles. The person resting their feet on the foot pedal. The person gripping with a hand at least one of the upper arm handles.

Implementation may include one or more of the following. The first beam, the second beam, and the third beam may be positioned consecutively along the central axis. The floor frame may include a first anti-tipping beam and a second anti-tipping beam. The foot support may be pivotable. The knee support may be adjustable. The waist support may be adjustable. The waist support may be cushioned.

In one aspect, the method for stretching a human body includes a person engaging a stretching apparatus. The stretching apparatus includes a first beam coupled substantially perpendicular to the floor frame. The first beam includes a foot pedal, a knee support, and a waist support. The stretching apparatus includes a second beam coupled substantially perpendicular to the floor frame. The second beam includes a plurality of lower arm handles. The stretching apparatus includes a third beam coupled substantially perpendicular to the floor frame. The stretching apparatus includes a fourth beam adjacently coupled to the third beam. The third beam has a plurality of upper arm handles. The person resting their feet on the foot pedal. The person gripping with a hand at least one of the lower arm handles.

Implementation may include one or more of the following. The first beam, the second beam, and the third beam may be positioned consecutively along the central axis. The floor frame may include a first anti-tipping beam and a second anti-tipping beam. The foot support may be pivotable. The knee support may be adjustable. The waist support may be adjustable. The waist support may be cushioned.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for stretching a human body comprising: a floor frame having a central axis; a first beam directly coupled substantially perpendicular to the floor frame, the first beam having: a foot pedal; a knee support; and a waist support; a second beam directly coupled substantially perpendicular to the floor frame, the second beam having a plurality of lower arm handles; a third beam directly coupled substantially perpendicular to the floor frame; a fourth beam adjacently coupled to the third beam and bent toward the first beam to form an angle between the third beam and fourth beam, the fourth beam having a plurality of upper arm handles; and the second beam being disposed between the first beam and the third beam.

2. The apparatus of claim 1 wherein the first beam, the second beam, and the third beam are consecutively positioned along the central axis.

3. The apparatus of claim 1 wherein the floor frame has:

a first anti-tipping beam; and a second anti-tipping beam.

4. The apparatus of claim 1 wherein the foot pedal is pivotable.

5. The apparatus of claim 1 wherein the knee support is adjustable.

6. The apparatus of claim 1 wherein the waist support is adjustable.

7. A method for stretching a human body comprising: a person engaging a stretching apparatus, the stretching apparatus having: a floor frame having a central axis; a first beam directly coupled substantially perpendicular to the floor frame, the first beam having: a foot pedal; a knee support; and a waist support; a second beam directly coupled substantially perpendicular to the floor frame, the second beam having a plurality of lower arm handles; a third beam directly coupled substantially perpendicular to the floor frame; a fourth beam adjacently coupled to the third beam and bent toward the first beam to form an angle between the third beam and fourth beam, the fourth beam having a plurality of upper arm handles; the second beam being disposed between the first beam and the third beam; the person resting their feet on the foot pedal; and the person gripping with a hand at least one of the upper arm handles.

8. The method of claim 7 wherein the first beam, the second beam, and the third beam are consecutively positioned along the central axis.

9. The method of claim 7 wherein the floor frame has:

a first anti-tipping beam; and a second anti-tipping beam.

10. The method of claim 7 wherein the foot pedal is pivotable.

11. The method of claim 7 wherein the knee support is adjustable.

12. The method of claim 7 wherein the waist support is adjustable.

13. The method of claim 7 wherein the waist support is cushioned.

14. A method for stretching a human body comprising: a person engaging a stretching apparatus, the stretching apparatus having: a floor frame having a central axis; a first beam directly coupled substantially perpendicular to the floor frame, the first beam having: a foot pedal; a knee support; and a waist support; a second beam directly coupled substantially perpendicular to the floor frame; the second beam having a plurality of lower arm handles; a third beam directly coupled substantially perpendicular to the floor frame; a fourth beam adjacently coupled to the third beam and bent toward the first beam to form an angle between the third beam and fourth beam, the fourth beam having a plurality of upper arm handles; the second beam being disposed between the first beam and the third beam; the person resting their feet on the foot pedal; and the person gripping with a hand at least one of the lower arm handles.

15. The method of claim 14 wherein the first beam, the second beam, and the third beam are consecutively positioned along the central axis.

16. The method of claim 14 wherein the floor frame has:

a first anti-tipping beam; and a second anti-tipping beam.

17. The method of claim 14 wherein the foot pedal is pivotable.

18. The method of claim 14 wherein the knee support bar is adjustable.

19. The method of claim 14 wherein the waist support bar is adjustable.

20. The method of claim 14 wherein the waist support is cushioned.

* * * * *